US005842645A

United States Patent [19]

Degongre et al.

[11] Patent Number: 5,842,645

[45] Date of Patent: Dec. 1, 1998

[54] DEVICE FOR GENERATING FOAM IN A SHOWER

[76] Inventors: Gilles Degongre; Denis Degongre, both of 14179, rue Gilles, Mirabel, Canada, J7J 1H8

[21] Appl. No.: 652,749

[22] Filed: May 23, 1996

[30] Foreign Application Priority Data

May 24, 1995 [CA] Canada ..... 2150067

[51] Int. Cl.[6] ..... B05B 7/28

[52] U.S. Cl. ..... 239/312; 239/316; 239/335; 239/444; 239/446; 239/581.1; 4/615

[58] Field of Search ..... 239/310–312, 239/315–318, 335, 336, 379, 443, 446, 444, 581.1; 4/903, 615

[56] References Cited

U.S. PATENT DOCUMENTS

| | | | |
|---|---|---|---|
| 2,562,415 | 7/1951 | Chase | 239/310 X |
| 3,091,402 | 5/1963 | Palmer | 239/305 X |
| 3,134,545 | 5/1964 | Armond | 239/312 |
| 3,581,996 | 6/1971 | Boyer | 239/317 |
| 3,601,510 | 8/1971 | Sadler | 417/503 |
| 3,708,122 | 1/1973 | Stuy | 239/317 |
| 3,917,172 | 11/1975 | O'Hare | 239/305 |
| 4,027,822 | 6/1977 | Usher | 239/305 |
| 4,193,520 | 3/1980 | Duffield | 222/133 |
| 4,200,206 | 4/1980 | Chase et al. | 239/307 X |
| 4,219,158 | 8/1980 | Lacy | 239/305 |
| 4,358,056 | 11/1982 | Greenhut et al. | 239/305 |
| 5,135,173 | 8/1992 | Cho | 239/305 |

FOREIGN PATENT DOCUMENTS

| | | | |
|---|---|---|---|
| 583128 | 9/1959 | Canada | 239/311 |

*Primary Examiner*—Lesley D. Morris
*Attorney, Agent, or Firm*—Fish & Richardson P.C.

[57] ABSTRACT

The device is used to generate foam and is installed between a conventional shower head and the corresponding water pipe. The device features a foam generator that uses air, water and a foaming liquid to generate foam inside a chamber located in the body of the device. A method for generating foam is also disclosed. In the device, the chamber is located under the container that provides the foaming liquid and is provided with a jet that receives deviated water and atomizes the water therein. Air is drawn inside the chamber. Foam is generated as the air, water and foaming liquid are mixed inside the chamber. The foam then flows out of the device through a spout. Operation of the device is achieved through the use of a rotative manual selector, by which the user selects various modes, including a soaping mode where only foam is generated. The device can allow a water economy of up to 75% of the water that could have been used otherwise and thus prevents natural resources from being wasted.

16 Claims, 8 Drawing Sheets

DEVICE FOR GENERATING FOAM IN A SHOWER

BACKGROUND

Conventional shower heads are designed so that water flows out from the beginning to the end of the shower. Since the flow of water is not essential at all time during a shower, for instance when the user soaps his or her body, there is a waste of water and particularly of hot water.

Known in the art are small valves located between the pressurized water conduit and the shower head for temporarily interrupting the flow of water. However, only few users use them because they are unattractive.

Also known in the art are reduced-flow shower heads. The main problem with these devices is that a reduced flow is not pleasant. Others have optimized flow but are costly.

Some devices were designed to provide a soap container at the level of the shower head so that the user be able to soap his or her body more quickly and more efficiently. Examples of such devices are disclosed in U.S. Pat. Nos. 3,601,510, 4,219,158, 4,358,056 and 5,135,173. None of these devices shows that it is possible to generate foam that may flow out of the device through an exit independent from the shower head, thereby allowing a substantial reduction of the water jet and a hot water economy. There is thus a need for such a device for allowing a user to use the water jet or the foam in an independent manner.

SUMMARY

The object of the present invention is to provide a device for generating foam for use with a shower head or the like, the device comprising:

a body;

a water circuit in the body, the water circuit having a water inlet for connection to a source of pressurized water, and a water outlet for receiving the shower head;

at least one container of foaming liquid;

foam generating means for generating foam inside the body using water and the foaming liquid;

deviation means connected to the water circuit for selectively deviating at least a fraction of the pressurized water towards the foam generating means;

manual control means for controlling of the deviation means from outside the body; and spout means for evacuating the foam outside the body.

It is also an object of the present invention to provide a method for generating foam in a device for use with a shower head or the like, the device comprising a water inlet for connection to a source of pressurized water, a water outlet for receiving the shower head, at least one container of foaming liquid and a chamber located under the container, the chamber having an air inlet and a foam outlet, the method comprising the steps of:

deviating at least a fraction of the pressurized water coming through the water inlet;

providing an amount of the foaming liquid in the chamber; and atomizing the deviated pressurized water in the chamber for drawing air inside the chamber through the air inlet and mixing the water with the foaming liquid for generating the foam to be evacuated through the foam outlet.

The device according to the present invention is primarily designed for being connected between the pressurized water conduit and the shower head. It may also be adapted for other locations, such as a sink.

Advantageously, the device should allow a water economy up to 75% of the water that could have been used otherwise. This is thus a hot water economy, therefore of energy, that prevents natural resources from being wasted.

A non restrictive description of a preferred embodiment will now be given with reference to the appended drawings.

BRIEF DESCRIPTION OF THE DRAWINGS

FIG. 2 is a longitudinal cross-sectional view of the device of FIG. 1, showing the various internal parts thereof.

FIG. 4 is a schematic view of the selector and the sliding member shown in FIG. 3, showing two positions thereof.

IDENTIFICATION OF THE COMPONENTS

Figure 1:
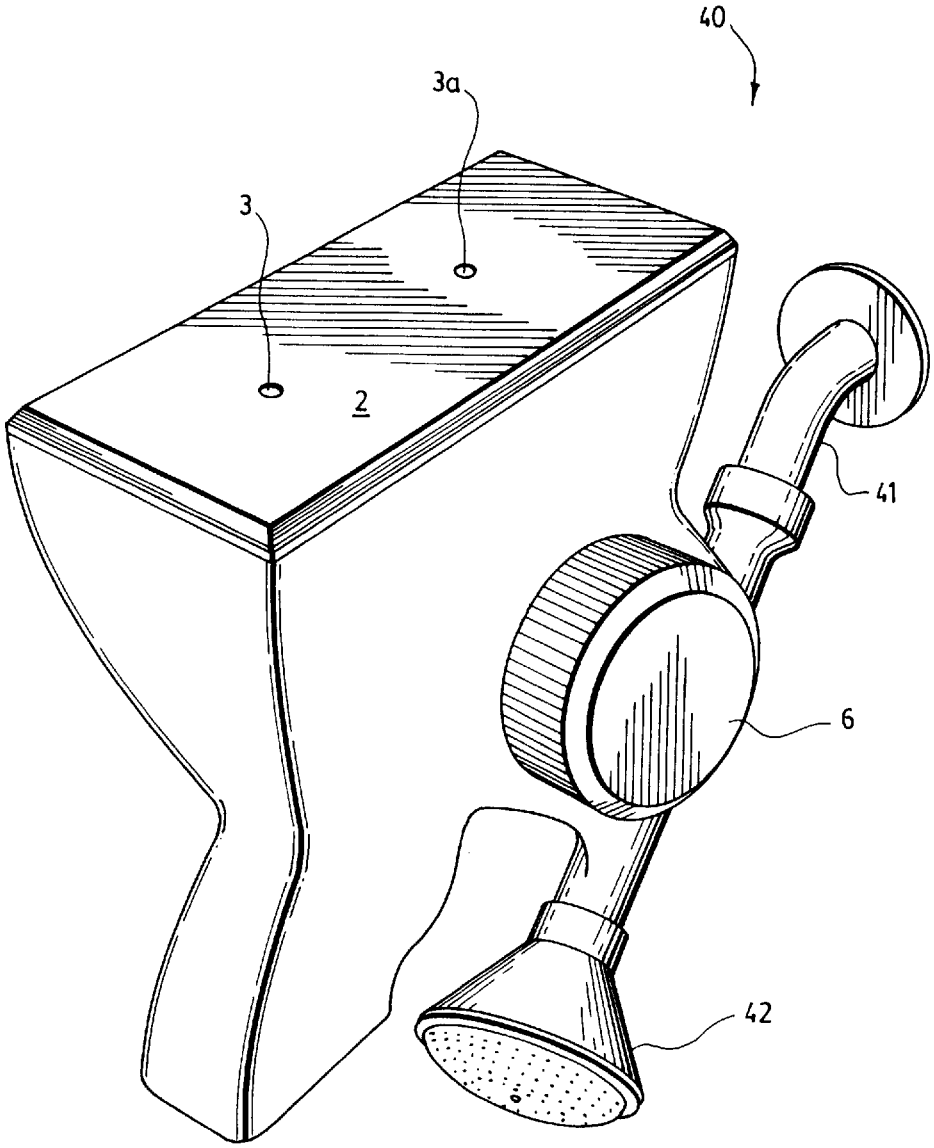
FIG. 1 is a perspective view of a device according to a preferred embodiment of the present invention.

The following is a list of the reference numerals, along with the names of the corresponding components, that are used in the appended drawings and in the description. This list is only given for the convenience of the readers and should not be interpreted as restricting the scope or spirit of the present invention.

| | |
|---|---|
| 1 | first container |
| 1A | second container |
| 2 | lid |
| 3 | vent hole (in the lid) |
| 3A | vent hole (in the lid) |
| 4 | protective screen |

-continued

| | |
|---|---|
| 5 | water diffuser |
| 6 | manual selector |
| 7 | water inlet |
| 8 | water outlet |
| 9 | first channel |
| 10 | basin |
| 11 | spout |
| 12 | opening (basin) |
| 13 | sliding member |
| 14 | spring |
| 15 | groove |
| 17 | rubber gasket |
| 18 | rubber gasket |
| 19 | insert |
| 20 | orifice(s) |
| 21 | foaming liquid outlet |
| 23 | first foaming liquid opening |
| 24 | second foaming liquid opening |
| 25 | housing (for the sliding member) |
| 26 | peg (for the water valve) |
| 27 | foam |
| 28 | jet |
| 29 | housing (for insert) |
| 30 | side opening (of water valve) |
| 31 | bore (of water valve) |
| 33 | water valve |
| 34 | rubber seat |
| 35 | water level |
| 36 | position indicator |
| 37 | position indicator |
| 38 | air inlet |
| 40 | device |
| 41 | pressurized water conduit |
| 42 | shower head |

DESCRIPTION

Referring now to FIGS. 1 to 5, there is shown a preferred embodiment of the device according to the present invention.

FIG. 1 shows the device (40) when ready for use. The device (40) is connected to a conduit (41) acting as a source of pressurized water during the shower of the user. A shower head (42) is connected to the device (40). Of course, the expression "shower head" includes the variants such as a shower head connected at the end of a flexible pipe or any kind of water outlet adapted for use in a shower. Moreover, since the conduit (41) is not always under pressure, the expression "pressurized water" only means that the water is under pressure in the conduit (41) during the time the user takes a shower.

The device (40) comprises a water circuit inside the body of the device (40). The water circuit has a water inlet (7) for connection to the conduit (41). The water circuit further has a water outlet (8) on which the shower head (42) is connected.

In the present embodiment, two containers (1,1A) hold foaming liquids, such as liquid soap, oils, shampoo, etc. These foaming liquids are used by the foam generating means for generating foam inside the body, as explained hereinafter. A lid (2), provided with vent holes (3,3A), is used to close the top portion of the containers (1,1A). Closed containers (not shown) with filling caps may also be used.

The water coming through the conduit (41) and then through the water circuit is selectively deviated by deviation means. An appropriate manual control means is used for controlling the deviation means from outside the body. In the present embodiment, the deviation means comprises a water valve (33) and an adjacent water channel (9) for bringing the water to the foam generating means.

The water valve (33) has three basic positions: an "off" position where no water flows in the water circuit, a "foam generation" position where foam is generated, and a "rinse" position where all the water flows through the shower head (42). No foam is generated in the "rinse" position. The water valve (33) is set inside the water circuit and is progressively movable between the various positions. Proper sealing engagement is maintained between the water valve (33) and the entry of the channel (9) by means of a rubber seat (34).

Figure 3:
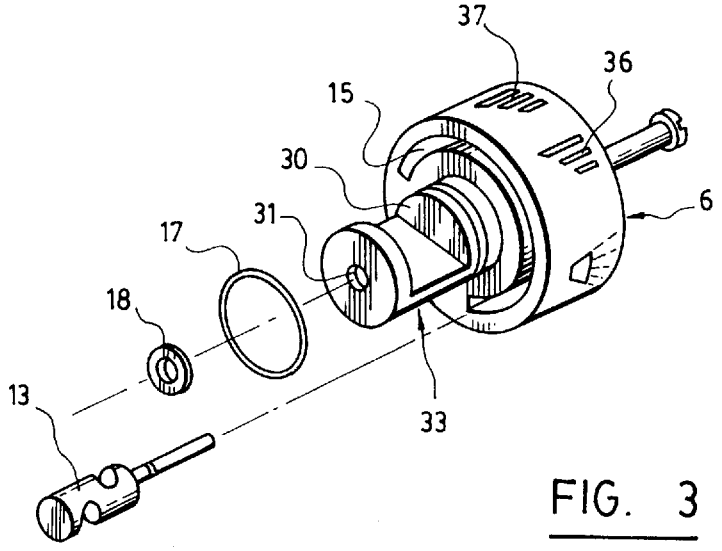
FIG. 3 is an exploded top perspective view of a selector of the device according to a preferred embodiment of the present invention, as connected to a rotative valve for controlling the deviation of pressurized water and a sliding member for controlling the flow of foaming liquid.

As shown in FIG. 3, the water valve (33) has a side opening (30). Rubber gaskets (17,18) provide proper sealing engagement of the water valve (33) with the other parts. The bottom end of the water valve (33) is held by means of a small bore (31) that connects on a corresponding peg (26).

Figure 2A:
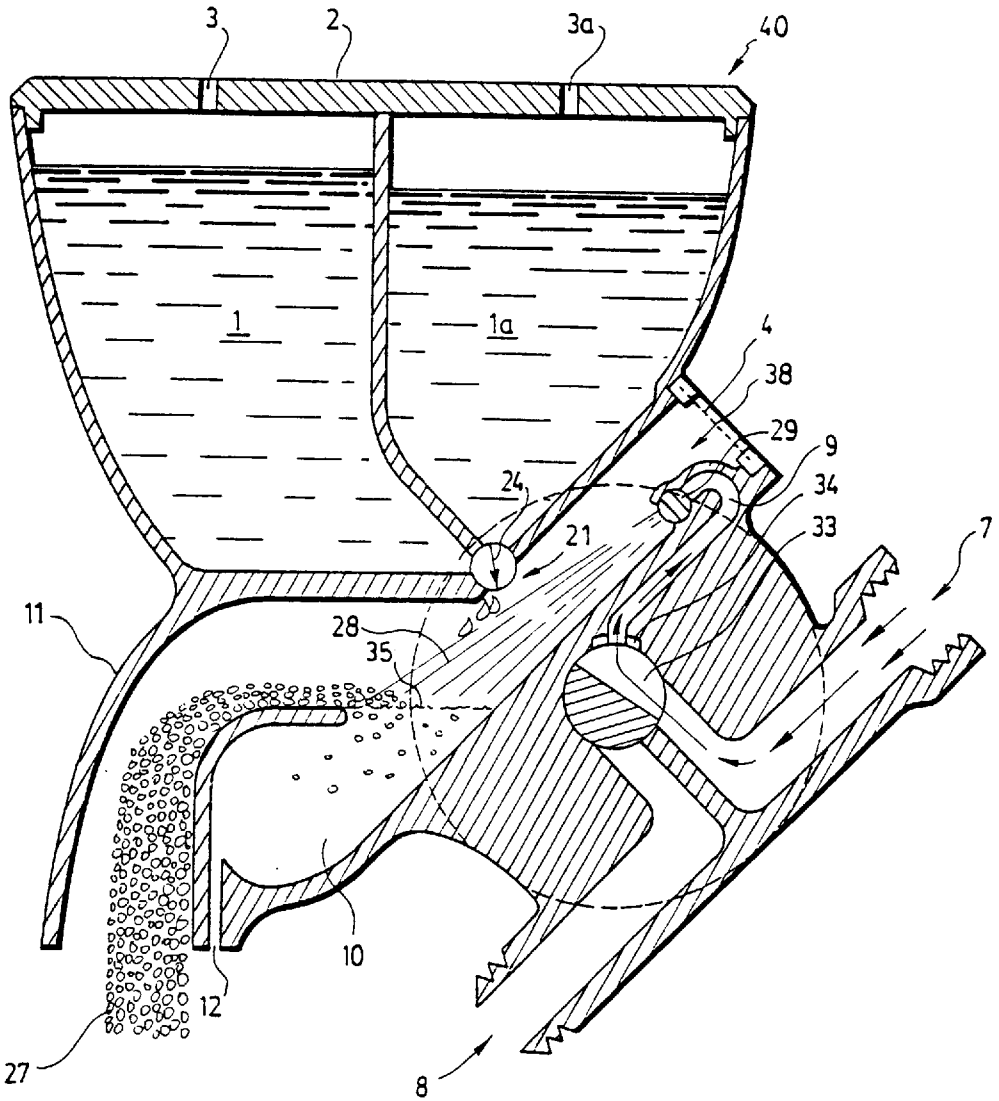
FIG. 2*a* is a longitudinal cross-sectional view of the device of FIG. 1, showing a mode of operation where foam is generated with one of the foaming liquids and where the water flow towards the shower head is interrupted.
Figure 2B:
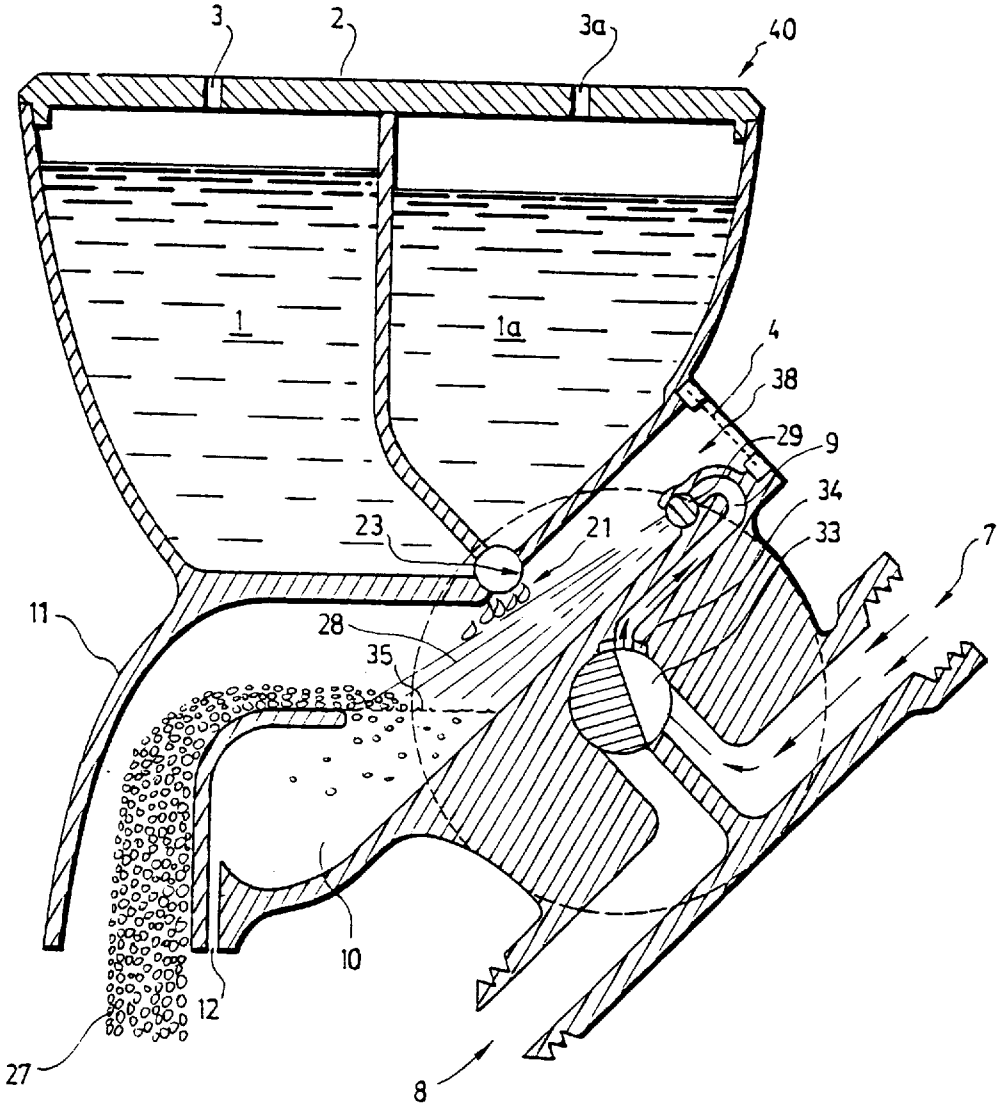
FIG. 2*b* is a view similar to FIG. 2*a,* showing another mode of operation where the foam is generated with the other of the foaming liquids and where the flow of water towards the shower is interrupted.
Figure 2C:
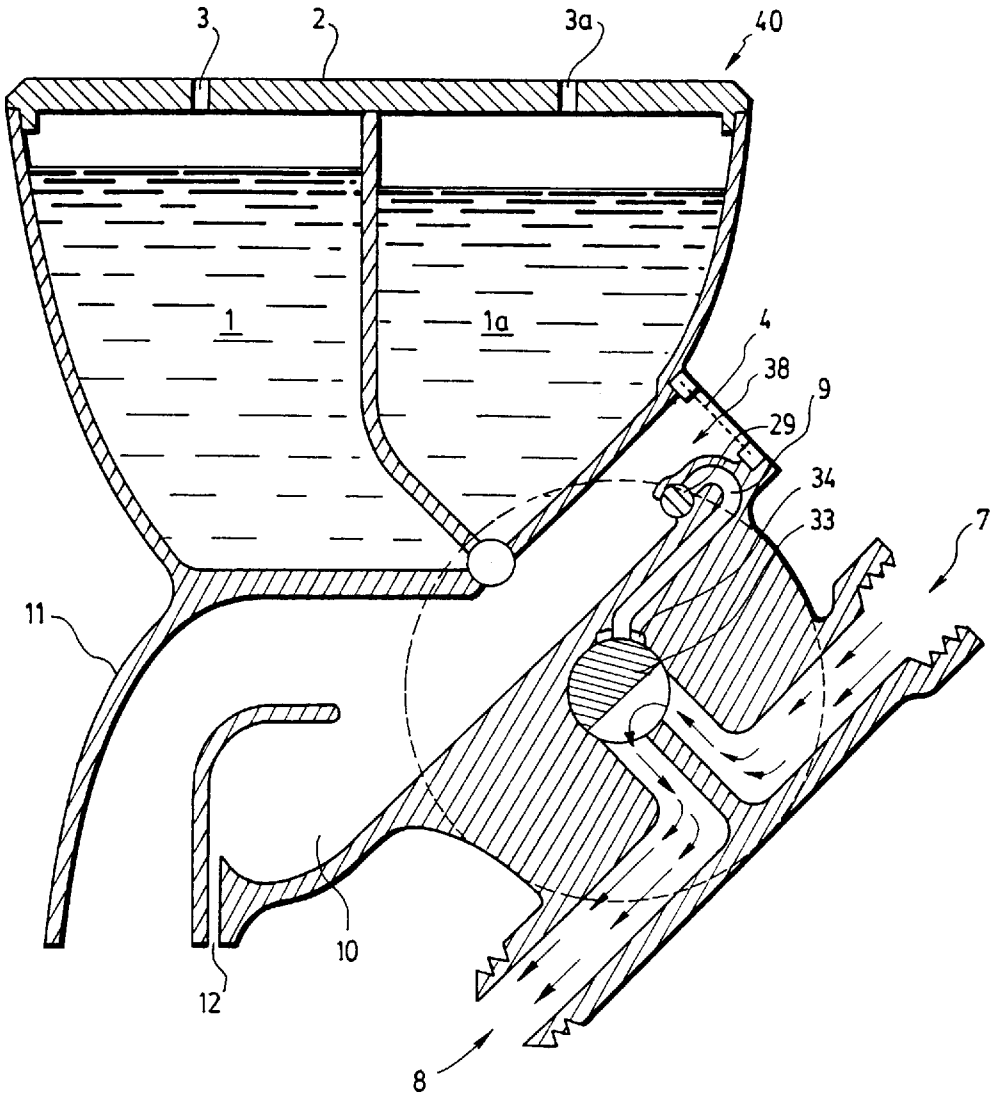
FIG. 2*c* is a view similar to FIGS. 2*a* and 2*b,* showing another mode of operation where no foam is generated and where the flow of water towards the shower head is enabled.
Figure 2D:
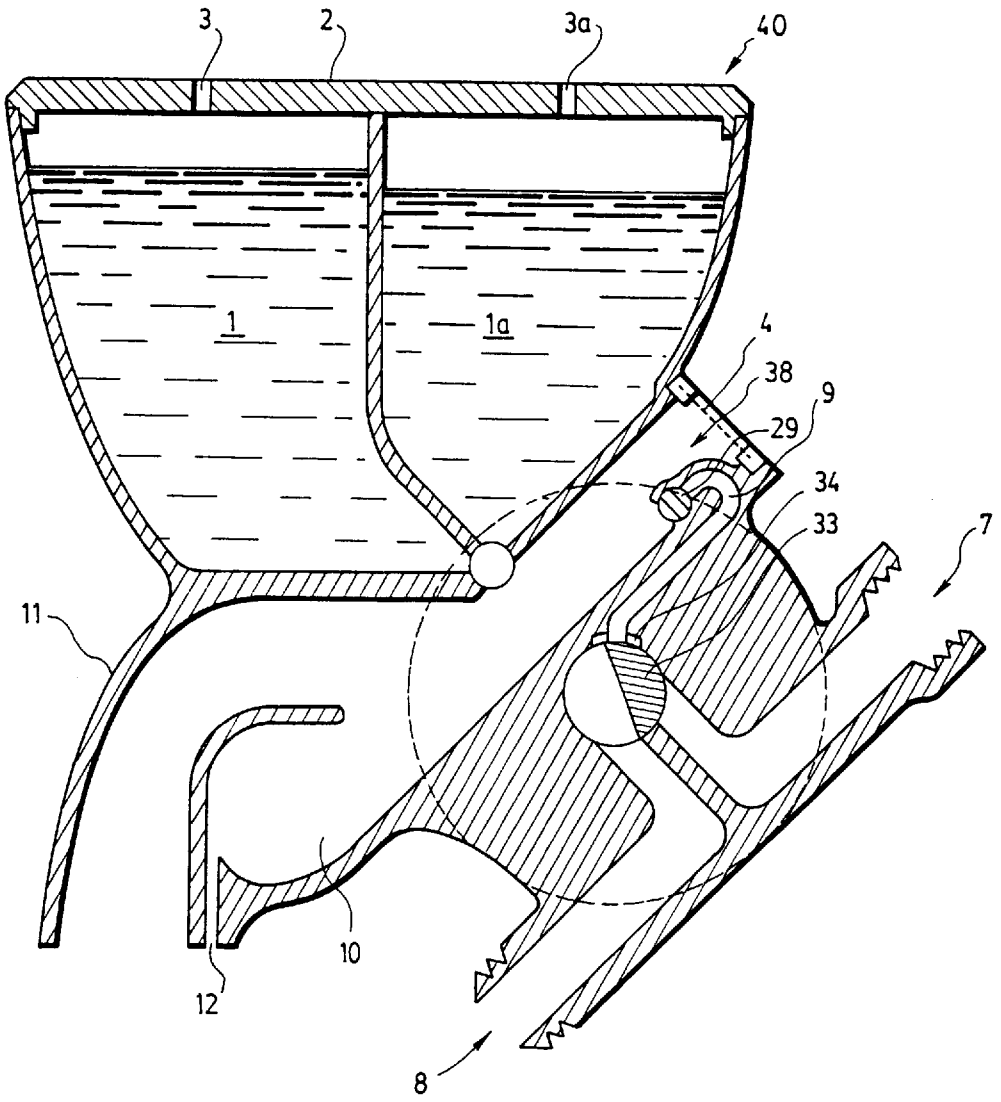
FIG. 2*d* is a view similar to FIGS. 2*a,* 2*b* and 2*c,* showing another mode of operation where the generation of foam and the flow of water are completely interrupted.

As shown in FIGS. 2 to 2*d,* the foam generating means comprises a chamber located under the containers (1,1A). One end of the chamber is connected to a spout (11) for evacuating the foam (27) outside. The spout (11) may be in the form of an elongated nozzle provided with a substantially downwardly-facing outlet.

Liquid providing means are used for providing the chamber in foaming liquid coming from one and possibly more than one container (1,1A). These liquid providing means comprise at least one channel having an end emerging in the chamber so that the liquids may be brought therein.

To generate the foam, the foam generating means comprise a water diffuser (5) that creates a jet (28) with the pressurized water coming from the water channel (9). This water diffuser (5) comprises at least one orifice (20) for diffusing water in a spray combined with a stream that is substantially aimed at the foaming liquid outlet (21) located in the top wall of the chamber. The stream is used to partially draw the amount of liquid. The liquid flows by gravity but since its viscosity is usually important, the stream helps to keep a proper flow. As for the spray, its main role is to mix the water with the foaming liquid and to introduce an amount of air in the mixture for generating the foam. The air is provided inside the chamber by an appropriate means, such as an air inlet (38) adjacent to the water diffuser (5). A protective screen (4) prevents foreign objects from entering into the chamber.

Figure 5:
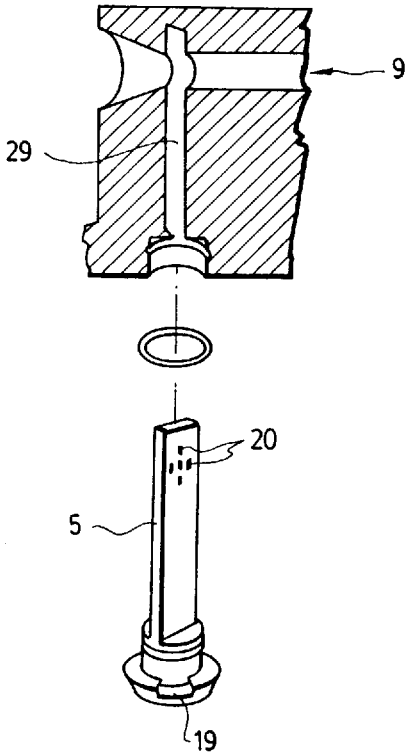
FIG. 5 is an exploded view showing the water diffuser in the device according to a preferred embodiment of the present invention.
Figure 4A:
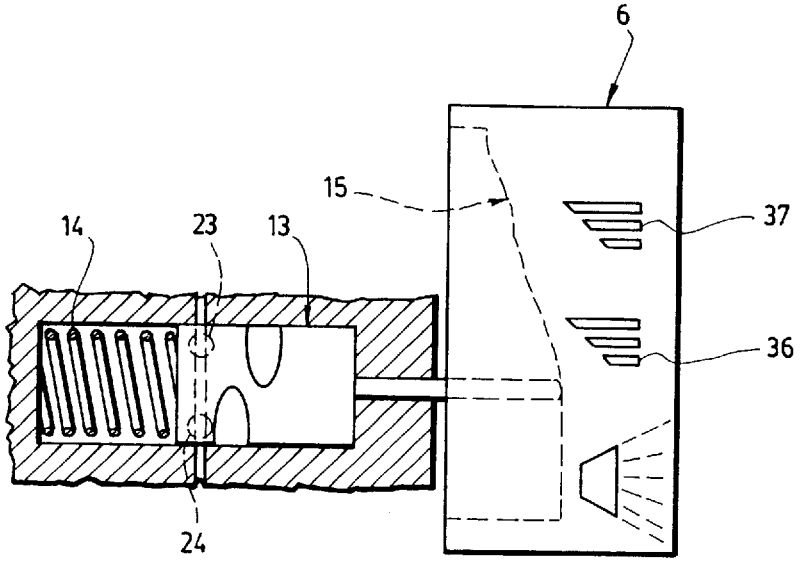
FIG. 4*a* is a partial cross-sectional view of the selector and the sliding member, shown at a position where the first and second foaming liquid openings are closed.
Figure 4B:
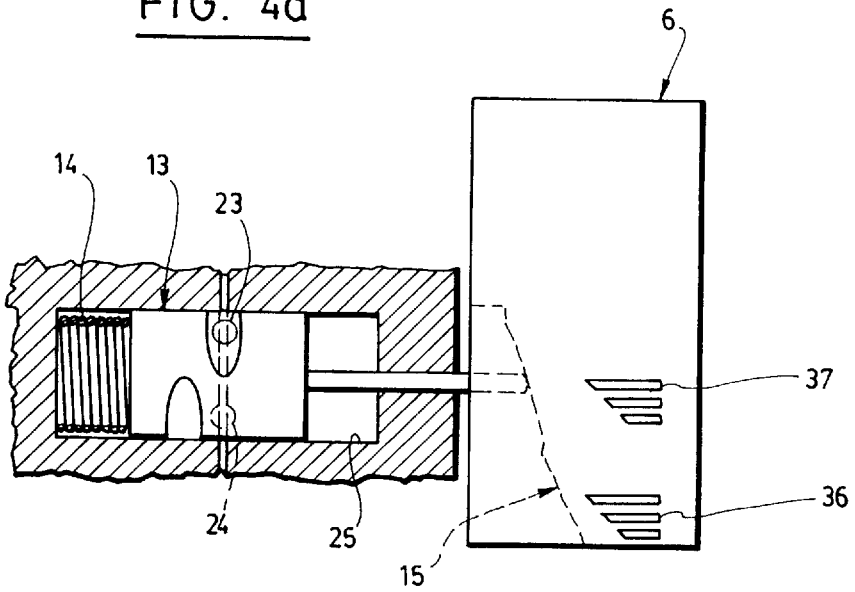
FIG. 4*b* is a view similar to FIG. 4*a,* showing the selector and the sliding member at another position where only the first foaming liquid opening is open.
Figure 4C:
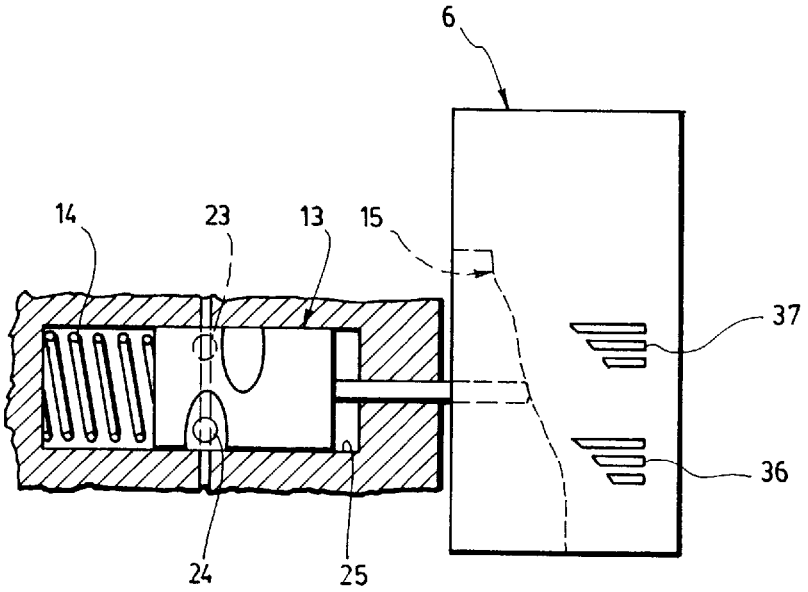
FIG. 4*c* is a view similar to FIGS. 4*a* and 4*b,* showing the selector and the sliding member at another position where only the second foaming liquid opening is open, showing two positions thereof.

Since the water diffuser (5) may become clogged over time, it is advantageous to provide a removable insert (19) which may be inserted into a corresponding housing (29). As shown in FIG. 5, the removable insert bears the water diffuser (5). It should be removable with an appropriate means, such as a screwdriver or the like.

The device (40) is preferably controlled by a rotative manual selector (6) located on the side of the central part thereof. This selector (6) is preferably combined with the water valve (33) and a foaming liquid valve used for selectively opening and closing the channel providing the foaming liquids to the chamber. By providing such a combined selector (6), the foaming liquid valve is then synchronized with the water valve (33). Position indicators (36,37) allow the user to properly set the selector (6) to the desired mode.

The foaming liquid valve comprises a sliding member (13) operatively connected to a circular groove (15) of variable depth in the selector (6). The sliding member (13) is movable in a corresponding housing (25) and is biased against the groove (15) by means of a spring (14). The sliding member (13) also has the function of selecting one of the containers (1,1A) if there are more than one. To do so, as shown in FIG. 3, the sliding member (13) comprises transversal slots to be aligned with openings (23,24) connected to a corresponding container (1,1A).

Referring back to FIGS. 2 to 2*d,* the chamber preferably comprises a settling basin (10) provided with a bottom reduced opening (12) for draining any surplus of water or foaming liquid therein, such as when the shower is over. Water accumulates in the basin (10) up to the water level (35). The foam floats at the surface of the water and then flows out through the spout (11).

In use, the device (40) according to the present invention also provides a new method for generating foam. In this method, at least a fraction of the pressurized water coming through the water inlet is first deviated. Then, the foaming liquid is provided in the chamber. The deviated pressurized water is atomized in the chamber for drawing air inside the chamber through the air inlet and mixing the water with the foaming liquid for generating the foam. The foam is evacuated through the foam outlet.

The water economy is achieved when the user sets the selector (6) to only produce the foam (27). During that time, the flow of water through the shower head (42) is stopped and no water is wasted. The user then collects the foam (27) coming out of the spout (11) and uses it according to the needs, for instance on the body for soap and on the head for shampoo. The foam (27) flows out continuously by itself as foam is constantly generated in the chamber. If desired, the user may stop completely the flow of both water and foam using the selector (6).

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A device for generating foam for use with a shower head or the like, the device comprising:

a body, said body comprising a spout;

a water circuit in the body, the water circuit having a water inlet for connection to a source of pressurized water, and a water outlet for directing water to the shower head;

at least one container that provides a foaming liquid;

a foam generator that uses air, water and said foaming liquid to generate foam inside the body, the foam generator comprising:

a chamber located under the container, the chamber being in communication with the spout to direct said foam outside the body;

a foaming liquid flow path that directs foaming liquid to the chamber from the container, the foaming liquid flow path having an outlet in the chamber;

a jet arranged to receive water from the water channel and atomize said water inside said chamber; and an air inlet to provide air into the chamber a water deviator connected to the water circuit and operable to selectively deviate at least a fraction of the pressurized water towards the foam generator, the water deviator comprising a water valve set inside the water circuit, the water valve being movable between a first position where the pressurized water flows only towards the water outlet and a second position where the pressurized water is deviated through a water channel, the water channel having one end in fluid communication with the water valve and another end directing water to the foam generator; and a manual control connected to the water deviator and operable from outside the body.

2. A device according to claim 1, wherein the water valve is moveable to a third position for completely interrupting the flow of pressurized water, where no pressurized water flows through either the water outlet or through the water channel.

3. A device according to claim 1, wherein the air inlet is in sufficiently close proximity to the jet that air is drawn through the inlet into the chamber by operation of the jet.

4. A device according to claim 3, wherein the jet comprises a water diffuser having at least one orifice for diffusing water in a spray combined with a stream that is substantially aimed at the outlet of the liquid flow path.

5. A device according to claim 4, including a foaming liquid valve for controlling a flow of foaming liquid.

6. A device according to claim 5, wherein the foaming liquid valve comprises a sliding member.

7. A device according to claim 5, wherein the foaming liquid valve is operatively connected to the manual control for synchronized operation of the water valve and the foaming liquid valve.

8. A device according to claim 7, wherein the manual control comprises a rotative manual selector, the water valve comprising a rotative member directly connected to the selector, the foaming liquid valve comprising a sliding member operatively connected to a circular groove of variable depth in the selector, the sliding member being biased in the groove by means of a spring.

9. A device according to claim 5, wherein the device comprises two containers, the foaming liquid flow path further including a flow selector for selecting flow from one of the containers.

10. A device according to claim 1, wherein the chamber comprises a settling basin provided with a bottom reduced opening for draining any surplus of water or foaming liquid therein.

11. A device according to claim 1, wherein the spout comprises an elongated nozzle provided with a substantially downwardly-facing outlet.

12. A method for generating foam in a device for use with a shower head or the like, the device comprising a water inlet for connection to a source of pressurized water, a water outlet for receiving the shower head, at least one container of foaming liquid and a chamber located under the container, the chamber having an air inlet and a foam outlet, the method comprising the steps of:

deviating at least a fraction of the pressurized water coming through the water inlet;

providing an amount of foaming liquid in the chamber; and atomizing the deviated pressurized water in the chamber for drawing air inside the chamber through the air inlet and mixing the water with the foaming liquid for generating the foam to be evacuated through the foam outlet.

13. A device for selectively mixing an additive to water for use with a shower head or the like, comprising:

a water inlet for receiving pressurized water from a source, a first flow path for directing water to a first outlet, and a second flow path for directing water to a separate, second outlet, a vent to let air into said second flow path, an additive inlet in communication with said second flow path for receiving said additive and mixing said additive with air and water in said second flow path, a first valve for deviating water selectively to said first and second flow path, a second valve for selectively permitting or stopping the flow of said additive, and a control knob for manually controlling said first and second valve in coordinated fashion such that flow of said additive is reduced when water is deviated to said first flow path and flow of said additive is increased when water is deviated to said second flow path.

14. The device of claim 13 wherein said valve is operable to prevent water flow through the device.

15. A device for selectively mixing an additive to water for use with a shower head or the like, comprising:

a water inlet for receiving pressurized water from a source, a first flow path for direction water to a first outlet, and a second flow path for directing water to a separate, second outlet, a vent to let air into said second flow path, an additive inlet in communication with said second flow path for receiving said additive and mixing said additive with air and water in said second flow path, a first valve for deviating water selectively to said first and second flow path, a second valve for selectively permitting or stopping the flow of said additive, and an atomizer arranged to atomize water in said second flow path.

16. The device of claim 15 wherein said valve is operable to prevent water flow through the device.

* * * * *